United States Patent [19]

Schubert

[11] 4,148,743

[45] Apr. 10, 1979

[54] PROCESS FOR MAKING A TOILET SOAP BAR CONTAINING POLYETHYLENE OXIDE

[75] Inventor: Warren R. Schubert, Somerset, N.J.

[73] Assignee: Colgate-Palmolive Company, New York, N.Y.

[21] Appl. No.: 858,044

[22] Filed: Dec. 6, 1977

Related U.S. Application Data

[63] Continuation of Ser. No. 693,076, Jun. 4, 1976, abandoned.

[51] Int. Cl.[2] ..... C11D 9/26; C11D 9/40

[52] U.S. Cl. ..... 252/132; 252/134; 252/174

[58] Field of Search ..... 252/90, 132, 134, 174, 252/367, 368; 424/177, 354; 264/75; 427/212

[56] References Cited

U.S. PATENT DOCUMENTS

| | | | |
|---|---|---|---|
| 2,999,068 | 9/1961 | Pilcher et al. | 252/528 |
| 3,248,333 | 4/1966 | O'Roark | 252/141 |
| 3,548,056 | 12/1970 | Eigen et al. | 424/171 |
| 3,676,538 | 7/1972 | Patterson | 264/75 |
| 3,832,310 | 8/1974 | Grand | 252/543 |
| 3,941,722 | 3/1976 | Shevlin | 252/524 |
| 3,944,663 | 3/1976 | Weiss et al. | 424/78 |

OTHER PUBLICATIONS

Davidson et al., "Water-Soluble Resins", Reinhold Pub. Corp., N. Y., 1962, pp. 197-201.

Riso, "Protein Derivatives", Aerosol Age, Apr. 1967, pp. 50, 52, 55 and 57.

Riso, "Protein Detergents", Stepan Chem. Co., Maywood, N. J., pp. 1-8.

*Primary Examiner*—Harris A. Pitlick

*Attorney, Agent, or Firm*—Herbert S. Sylvester; Murray M. Grill; Norman Blumenkopf

[57] ABSTRACT

Process for preparing toilet soap bars containing high molecular weight polymers of ethylene oxide, said bars characterized by having a smooth surface like that of conventional soap bars.

7 Claims, No Drawings

PROCESS FOR MAKING A TOILET SOAP BAR CONTAINING POLYETHYLENE OXIDE

This is a continuation of application Ser. No. 693,076, filed June 4, 1976 and now abandoned.

This invention relates to the incorporation of very high molecular weight poly (ethylene oxide) into a toilet soap bar. The inclusion of such poly (ethylene oxide) makes it possible to provide a hard tough bar which has a degree of slipperiness when wetted which is especially pleasant to the user, gives a lather which is creamy, pleasant silky and effective, has good resistance to sloughing in use despite a high moisture pickup, has long life, is flexible and tough even after much of the bar has been used up, and provides a beneficial effect on the hands (e.g. reduces chapping and flaking, moisturizing the skin, particularly for dry skins).

When it is attempted to incorporate the high molecular weight poly (ethylene oxide), which is supplied as a dry powder, into a toilet bar using the methods by which powdered ingredients are conventionally added (e.g. by addition to the soap amalgamator along with the other ingredients) it is found that the resulting toilet bars have spaced visible and palpable specks. These specks are sometimes observed on the surface of the final pressed bar or they become evident when the bar is washed in cold water. For instance there may be some 50 to 500, or more, visible specks per bath size bar. Examination of these specks reveals that they are agglomerates or gels containing poly (ethylene oxide); typically, the volume of a speck is about 0.0005 cubic millimeters ($mm^3$) to 0.3 $mm^3$. It is found that the formation of such specks can be substantially avoided by mixing soap chips with the poly (ethylene oxide) powder while the surfaces of said soap chips are in powder-adherent condition with respect to said polyethylene oxide powder, to produce soap chips having poly (ethylene oxide) bonded thereto, then adding other ingredients of said toilet soap bar and mixing said other ingredients with said bonded chips, then forming the resulting mixture into a soap bar. Two preferred processes are (a) add the powdered high molecular weight poly (ethylene oxide) to soap chips having a moisture content such that the powder adheres thereto (e.g. at least about 11% $H_2O$) and mixing before adding the other solid ingredients, or (b) add the powdered high molecular weight polyethylene oxide to soap chips having a lower moisture content, mix, and then carefully add some water in a finely dispersed state (e.g. to bring the water content, based on soap, to a level sufficient to provide powder adhesion) before adding the other solid ingredients. The reason for this effect is not understood, but it appears that the particles of high molecular weight poly (ethylene oxide) (whose moisture sorption is below 3% at a relative humidity of 60% at 25° C., according to the manufacturer's bulletins) take up sufficient moisture from the higher moisture content soap chips and become bonded, individually, to the surfaces of the chips so that these particles are thus prevented from agglomerating. if there is not sufficient moisture for this to occur before the subsequent addition of other solid ingredients (particularly powders of low moisture contents, e.g., below about 8% water), the latter may compete for the limited amount of moisture available, and loose particles of high molecular weight polyethylene oxide may agglomerate in later stages.

The powder-adherent property of the soap chips may be tested in the manner illustrated in Example I below. Best and most consistent results are obtained when the moisture content of the surface is such that the power "disappears" on remaining in contact with the surface for a short time (e.g. 1 to 2 minutes) as for the 15% moisture chip in Example I.

DETAILED DESCRIPTION OF THE INVENTION

The soap constitutes at least 60%, and preferably more than 70%, of the moisture-free weight of the bars of the present invention. The soap may be of a conventional type consisting predominantly of 12 to 18 carbon atom molecules and may be produced by the saponification of fatty materials suitable for use in soap making, suitable fatty materials comprising, for example, the fats, oils and waxes of animal, vegetable, and marine origin, and the fatty acids derived therefrom or of synthetic origin. More specifically, the fatty acids may be of mixed character such as are derived from natural or hydrogenated tallow, cottonseed oil, coconut oil, palm oil, palm kernel oil, babassu nut oil, grease, fish oils, and fatty acids derived therefrom by hydrolysis of saponification or may be pure materials such as lauric, myristic, palmitic, stearic and oleic acids. It is generally preferred to use in the present invention the sodium salts of the mixed fatty acids derived from tallow and coconut oil and mixtures thereof. A desirable blend has a weight ratio of sodium coco soap to sodium tallow soap in the range of about 50:50 to about 10:90, with a ratio below about 30:70, e.g. a range of about 25:75 to about 17:83 being especially preferred. As is known in the art, the higher coco contents give faster more copious lather but more irritation, in conventional soaps. It is within the broader socpe to use blends of the sodium soaps and the corresponding potassium soaps (e.g in mole ratios of sodium-potassium of 90:10 or 75:25).

The high molecular weight poly (ethylene oxide) has an average molecular weight of at least about 100,000. Examples of such compounds are those sold by Union Carbide Company under the trademark "Polyox". These polymers are nonionic and extremely soluble in water and their molecular weights range from about 100,000 to about 5,000,000 or more. It is preferred to employ polymers having average molecular weights below 1,000,000, more preferably not above 600,000 such as about 300,000 to 400,000. The proportion of high molecular weight polymer of ethylene oxide in the toilet bar is generally below about 10% and is preferably more than about 0.5% e.g. at least about 1%, and less than about 5%, more preferably below 4%. For the material having an average molecular weight of about 300,000 a proportion in the neighborhood of 2% has given excellent results. This 300,000 molecular weigth material (sold as Polyox WSR N-750) has a viscosity at 25° C. for a 2% aqueous solution, of about 40 centipoises (Brookfield Spindle No. 1 at 10 rpm) for a 5% solution this viscosity is about 600–1000 centipoise. Use of say 2% of extremely high molecular weight poly (ethylene oxide), e.g. of 4,000,000 average molecular weight, causes the lather to be pituitous, which is less desirable. According to the manufacturer the Polyox materials typically have a pH of about 10 (e.g. in 5% solution). Soap typically has a pH in 1% aqueous solution of about 10 (e.g. 10.2).

The poly (ethylene oxide) is generally supplied as a powder and typically has the following particle size distribution when a sample thereof is screened through a series of sieves, expressed as weight percent retained on the indicated Sieve No. screen (U.S. Sieve Series): No. 20–5.2%; No. 40–31.2%; No. 60–20.7%; No. 100–16.7% and through No. 100-balance. It is often preferable to use a finer particle size poly (ethylene oxide) having the following distribution as measured above: No. 20–0.3%; No. 40–13%; No. 60–13%; Nc. 100–13.9% and through No. 100-balance.

The invention has found its greatest utility so far in the production of bars containing hydrolyzed protein. A particularly preferred hydrolyzed protein is Protein A sold by Croda Inc., New York, N.Y. and is a partially enzymatically hydrolyzed protein derived from beef collagen and characterized by having a zero Bloom gram gel strength, a 10% weight/weight water solution having a viscosity range of about 16–25 millipoises (mps), a pH of 5.5–6.5, and in weight percent, a hydroxyproline content (mainly chemically combined hydroxproline) of about 10–12%, a nitrogen content of about 15–18%, and a total nitrogen as amino nitrogen of about 5–12%, and a molecular weight of about 1,000 to about 3,000, such as about 2,000. Its ash content is generally low (e.g. below 10%). Other hydrolyzed proteins which may be used include hydrolysis products comprising proteoses, peptones, and/or polypeptides, typically having a molecular weight of at least about 600 and below about 12,000, preferably below about 5,000, and including moieties of a plurality of amino acids. These hydrolysis products may be formed by partial enzymatic hydrolysis, such as by the action of trypsin, erepsin or pancreatic enzymes on protein material (e.g. at about 35°–50° C. for about 12–48 hours). The partially degraded protein may also be a product obtained by partial hydrolysis of protein by heat and/or alkali. Proteins partially degraded by heat may be prepared, for instance, by heating proteinaceous material such as bones, feet, or skin of pork or beef which has been reduced to small pieces and immersed in water, by autoclaving at about 2.8–3.5 kg/cm.$^2$ of saturated steam (i.e. about 141.5°–147.6° C.) for about two hours; three phases including fat, the desired aqueous phase, and a residue may thus be obtained: the aqueous phase which may contain about 8–10% solids may be concentrated in vacuo to about 50–60% solids at 60°–71° C. to obtain a "solubilized collagen," a heat degraded protein, which may be employed in this invention. Typical proteins which may be partially hydrolyzed for use in accordance with this invention include casein, gelatin, collagen, albumin, zein, gliadin, keratin, fibroin, globulin, glutenin, etc. Typical commercial partially enzymatically hydrolyzed proteins include Bacto-Proteose (sold by Difco Laboratories, Detroit, Mich.), proteus-peptone, casein-peptone, gelatin-peptone, Bacto-Peptone (sold by Difco Laboratories), vegetable peptones, such as soybeans peptone, Proto-Peptone (sold by Wilson Co., the peptone enzymatically derived from solubilized collagen using ground frozen pancreatic enzymes having a pH of 8. digestion being at about 40° C. for about 12–48 hours, the solubilized collagen being derived by heating bones, feet of skin or pork or beef). The preferred proteins are solubilized beef collagen and solubilized pork collagen which may be prepared as described and are generally characterized by a gel strength of about zero Bloom grams.

The partially hydrolyzed protein may have a relatively broad spectrum of molecular weights and may contain some (usually small amounts) of almost completely degraded polypeptides, such as dipeptides and tripeptides and even some amino acids as a result of the degradation process. If desired, these may be removed by dialysis, e.g., by placing the partially degraded protein in a cellophane bag which is then closed at both ends and is lowered into a tank into which deionized water continuously enters and from which it continuously exits; products such as the tripeptides, dipeptides, and amino acids pass out of the cellophane by dialysis to mix with the deionized water and leave the partially degraded protein. When employed, the dialysis procedure has the additional advantage of removing the odors of the more completely hydrolyzed material.

The proportion of protein ingredient in the toilet bar is generally about 0.1% and below about 10%. Amounts in the range of about 1% to about 5% are preferred with a level of about 3% being especially preferred. For the preferred protein mterial the 1–5% range provides a hydroxyproline content of about 0.1 to 0.5%, preferably about 0.3%.

In addition to, or in place of the protein, superfatting agents may be included. It is found that in the bars of this invention acetylated lanolin (such as, Modulan sold by American Cholesterol: see U.S. Pat. No. 2,725,334) gives especially good results. Other superfatting agents are hydroxylated lanolin, (e.g., OH Lan sold by American Cholesterol), higher (C10–C20) fatty acids such as stearic acid, coconut oil fatty acid, higher (C10–C20) fatty alcohols, petrolatum and the like. Amounts of superfatting agents less than 10% total are generally employed, preferably about 1%–5% e.g., 2%–3%.

The bars may also contain a synthetic surfactant of high foaming characteristics in hard water, such as alkali metal salts of organic sulfuric reaction products having in their molecular structure an alkyl radical of from about 8 to about 22 carbon atoms, e.g., alkyl benzene sulfonates, coconut oil fatty acid monoglyceride sulfonates and sulfates, alkali metal fatty acid (C10–C16) isethionates, among others, present in small amounts in the bar. A particularly preferred ester is sodium coco isethionate sold as Igepon AC-78 by the General Aniline and Film Corporation. The proportion of synthetic surfactant is generally within the range of about 0.5% to about 5% and preferably about 1% to about 3% e.g., about 2%. Preferably the weight ratio of synthetic surfactant to high molecular weight poly (ethylene oxide) is in the range of about 2:1 to 1:2, such as about 1:1.

In addition to the components listed above, it will be understood that the cleansing bar of the invention may contain other conventional additives in minor amounts including those usually found in such cleansing bars, such as fillers, perfumes, dyes, fungicides, humectants, (e.g. 0.2 to 1% of glycerine) and bactericides.

Toilet soap bars range in size from the relatively small hotel size (weighing about 20–30 grams) to the regular size (about 100 grams) to the bath size (about 150 g) to the extra large size (about 200 g). The bars of this invention may be of such sizes, particularly in the range of about 100 to 200 grams. The soap may also be aerated, in a manner well known in the art to give lower density (floating) soaps, such as those having a specific gravity of about 0.8.

The invention is particularly suitable for the making of milled and plodded toilet soap bars. Bars of this type are, of course, well known in the art; see for instance the description thereof in U.S. Pat. No. 3,179,596. Also see "Encyclopedia of Chemical Technology," Volume 12, edited by Kirk and Othmer, pages 573–598 and "Industrial Oil and Fat Products," Alton E. Bailey, Second Edition, 1951, pages 365–386 and 840–865. Thus one make take a kettle soap, form it into dried chips (as described in the foregoing references) and blend it with the various ingredients before milling and plodding.

The moisture contents of the toilet bars of this invention are such as to provide a solid non-tacky toilet bar. Preferably they are well below 30%. For a milled, plodded bar they are generally less than 20%, preferably in the range of about 10 to 17%, such as about 13%.

Milled plodded soaps typically are made up of fine crystals of hydrated fatty acid salt. The high molecular weight poly (ethylene oxide) appears to have an affinity for the moisture in the soap as shown by the experiment in Example I, but the physical state of this material in relation to the soap crystals is not presently known.

Various embodiments of the present invention will now be illustrated by reference to the following specific examples. It is to be understood, however, that such examples are presented for purpose of illustration only, and the present invention is in no way to be deemed as limited thereby.

EXAMPLE I

In this Example there are employed soap chips of various moisture contents (3%, 9%, 11%, 13% and 15%). 100 grams of soap chips are placed in a 400 cc. beaker and 2% of poly (ethylene oxide powder) is added thereto and mixed (tumbled) therewith by hand with a 1 inch wide spatula, for one minute. The poly (ethylene oxide) employed has a fine particle size as indicated by the preferable size as indicated hereinabove. The contents of the beaker are then spread on black paper. The paper is inspected with the naked eye to see the amount of powder left thereon and the chips are inspected under a 30-power microscope. When the chips contain 3 and 9% moisture substantially none of the powder adhere thereto and the black paper has a distinct layer of white powder. When the chips containing 11% moisture are stirred (with the spatula) the chips on the paper cause a noticeable release of powder (e.g. about 40% of the total powder) onto the paper; under the microscope the powder particles are seen to be distinct and resting on the surface of the soap chips and loosely adhering thereto. When the chips contain 13% moisture the powder is found to be more tightly held (e.g about 20% to 30% is released when the chips are stirred on the paper) under the microscope one can see distinct powder particles on the chip surfaces. When the chips contain 15% moisture substantially none of the powder is released onto the paper; microscopic examination, almost immediately, shows substantially no powder particles resting on the chip surfaces: the surfaces look substantially the same as if no powder has been added.

EXAMPLE II

A soap bar of the following composition is prepared by adding the ingredients in the order listed, to a conventional soap amalgamator (while the blades thereof are moving) operating at room temperature.

| Component | Weight % |
|---|---|
| Soap chips (17 coco Na soap/83 tallow Na soap)[1] | 88.50 |
| 50% aqueous solution of stannic chloride (a preservative) | 0.15 |
| Poly (ethylene oxide)[2] | 2.00 |

-continued

| Component | Weight % |
|---|---|
| Water | 1.00 |
| Titanium dioxide-powder (substantially moisture-free), (a pigment) | 0.60 |
| Protein A-powder (containing up to about 6% moisture) | 3.00 |
| Sodium coco isethionate-powder (containing about 1–2% moisture) | 2.00 |
| Glycerine | 0.50 |
| Acetylated lanolin[3] | 1.00 |
| Perfume | 1.25 |
| | 100.00 |

[1]Moisture is about 11.5%; bar moisture 10.5%; measured by weight loss at 105° C.
[2]Polyox WSR N-750 in the form of powder, of size such that less than about 5% by weight (e.g. 0.3%) is retained on a 20 mesh screen (U.S. Standard).
[3]Modulan-added in molten state (temperature of about 120° F.).

When added to the soap chips in the amalgamator, the individual particles of the homopolymer of ethylene oxide stick to the chips, especially when the water is then sprinkled onto the moving chips. The other ingredients are then added in the order indicated, while mixing is continued for a total of about 2 minutes. At this time the mixture is not clumped together, but is still flowable, in chip form.

The blend is then milled on a conventional five-roll soap mill to a thickness of about 0.05 to 0.1 mm the resulting milled chips having a temperature of about 34°–37° C. The chips are fed directly into a jacketed soap plodder and extruded to form a continuous bar ("plodder bar"). The plodding is controlled in one run to produce a plodder bar whose core temperature measured directly after extrusion is about 34°–38° C.; in a second run the temperature is controlled to give a plodder bar core temperature of 40°–43° C. The plodder used is a Doelyer-Kirsten eight inch double barrel Vacuum Plodder, Schwantes Design. The plodder bars are cut in conventional fashion to give units whose volumes are suitable for a toilet bar (e.g. about 140 g for a bath size bar and about 100 g for a regular size bar) pressed in conventional metal soap-pressing dies to the final rounded shape of the toilet bar. The units made from the higher temperature plodder bars are more difficult to press, without sticking to the die, but when the same plodder bar is cooled to about 38° C., the pressing is much better.

Examination and use of the bars show a smooth surface similar to that of normal soap bars. They are hard, tough, and shiny, have a degree of slipperiness when wetted which is especially pleasant to the user, give a lather which is creamy, pleasant, silky and effective, have good resistance to sloughing in use dispite a high moisture pickup, have long use lives and are flexible and tough even after much of the bar has been used up, and provide a beneficial effect on the hands (e.g. reduce chapping and flaking, moisturizing the skin, particularly for dry skins).

EXAMPLE III

Example II is repeated except that the sodium coco isethionate is omitted from the formulation and the soap content is correspondingly increased.

EXAMPLE IV

Example II is repeated except that the acetylated lanolin is omitted from the formation and the soap content is correspondingly increased.

EXAMPLE V

Example II is repeated, except that the coco and tallow soap ratio is 25/75, the soap chips have a higher moisture content (about 14% moisture), there is no separate addition of water (and the bar moisture content is thus above 13%), and higher plodder temperatures are used so as to produce a bar having a core temperature of about 50° C. The bar surface is then cooled (with cool air), and a film of pressing lubricant (e.g. an aqueous solution containing 16% NaCl and 25% glycerol) is directly applied to the pressing dies before each pressing operation.

EXAMPLE VI (a) Example II is repeated with the following formulation:

| Component | Weight % |
|---|---|
| Soap chips (25 coco/75 tallow) | 89.25 |
| 50% aqueous solution of stannic chloride | 0.15 |
| 50% aqueous solution of citric acid (to react with any excess alkali) | 0.25 |
| Poly (ethylene oxide)[1] | 2.00 |
| Titanium dioxide | 0.60 |
| Protein A | 3.00 |
| Sodium coco isethionate | 2.00 |
| Hydroxylated lanolin | 1.00 |
| Glycerine | 0.50 |
| Perfume | 1.25 |
| | 100.00 |

[1]Added as Polyox WSR N-750

[(b)]Example VI (a) is repeated except that the proportion of poly (ethylene oxide) is reduced to 1% and the soap content is raised by 1%. Users prefer the product of Example V (a).

[(c)]Example VI (a) is repeated but a second poly (ethylene oxide), 0.5% Polyox WSR-N-3000 (molecular weight 400,000), is also included and the soap content is correspondingly lowered to 88.75%.

EXAMPLE VII

Example VI is repeated except that the sodium coco isethionate is omitted (the soap chips being increased to 91.25%) and the polyethylene oxide has an average molecular weight of about 400,000 (Polyox WSR-N-3000).

EXAMPLE VIII

A series of soap bars are prepared as in Example II having the following composition:

| Component | Weight Per cent |
|---|---|
| Soap (25 coco Na soap/75 Tallow Na soap | 88.9 |
| Stearic acid | 4.7 |
| Poly (ethylene oxide) (Polyox WSR N-750) | 1.8 |
| Water | 2.4 |
| Titanium dioxide | 0.7 |
| Perfume | 1.5 |
| | 100.0 |

The stearic acid is added to a hot kettle soap, in a crutcher, and the resulting blend is then dried and formed into soap chips having a moisture content of 10.6% (measured by weight loss at 105° C.). The other ingredients are added in the amalgamator in the order listed. The moisture content of the bars is about 13%.

When these bars were evaluated by a handwashing panel against a commercial beauty soap, these bars were preferred in terms of over-all preference, lather, amount of lather, creaminess and richness of lather, and skin-feel. In contrast, when the same formulation, except for omission of poly (ethylene oxide) was similarly tested, the commercial beauty soap was preferred.

EXAMPLE IX

Example VIII is repeated using (a) coconut oil fatty acids or (b) palm fatty acids in place of the stearic acid.

EXAMPLE X

Example II is repeated except that 0.25% of a 50% aqueous solution of citric acid is added, the sodium coco isethionate is omitted (the soap chips being increased to 91.25%) and the polyethylene oxide has a molecular weight of about 400,000 (Polyox WSR-N-3000).

It will be apparent that many changes and modifications of the several features described herein may be made without departing from the spirit and scope of the invention. It is, therefore, apparent that the foregoing description is by way of illustration of the invention rather than limitation of the invention.

I claim:

1. Process for preparing toilet soap bars containing, approximately by weight, at least 60% of soap and between 0.5 and 10% of poly (ethylene oxide) having an average molecular weight of at least about 100,000 which comprises forming a first mixture of said soap in the form of chips and said poly(ethylene oxide) in the form of powder, said first mixture containing at least about 11% of moisture by weight of said chips whereby the surfaces of said soap chips are in powder-adherent condition with respect to said poly (ethylene oxide) powder, to produce soap chips having poly (ethylene oxide) bonded thereto, then mixing other conventional soap bar ingredients with said bonded chips to form a second mixture, then forming said second mixture into a soap bar.

2. Process as in claim 1 wherein said other ingredients contain only about 0.5 to 5% of synthetic surfactant by weight of the bar.

3. Process as in claim 1 wherein the moisture content of the soap chips is at least about 11% by weight.

4. Process as in claim 1 wherein the moisture content of the soap chips is less than about 11% by weight and sufficient water is added to said first mixture to provide said powder-adherent condition.

5. Process as in claim 1 wherein the other ingredients are selected from the group consisting of hydrolyzed protein, superfatting agent and a synthetic surfactant of high foaming characteristics and mixtures thereof.

6. A toilet soap bar produced by the process of claim 1.

7. A toilet soap bar containing by weight, about 0.5 to 10% of poly (ethylene oxide) having a molecular weight of at least 100,000 and at least 60% of soap, said bar being substantially free of visible specks caused by said poly(ethylene oxide).

8. A soap bar as in claim 7 wherein the poly(ethylene oxide) has a molecular weight of about 300,000 to about 400,000.

9. A soap bar as in claim 7 further containing about 0.1 to about 10% by weight of hydrolyzed protein.

10. A soap bar as in claim 9 wherein the hydrolyzed protein has a molecular weight of about 600 to about 12,000.

11. A soap bar as in claim 9 wherein the hydrolyzed protein has a molecular weight of about 1,000 to about 3,000

12. A soap bar as in claim 9 wherein the hydrolyzed protein is a collagen hydrolysis product.

13. A soap bar as in claim 9 containing about 1 to about 4% of the poly(ethylene oxide) and about 1 to about 5% of the hydrolyzed protein.

14. A soap bar as in claim 13 wherein the hydrolyzed protein provides a hydroxyproline content of about 0.1 to about 0.5%.

15. A soap bar as in claim 9 further containing a superfatting agent in an amount up to about 10%.

16. A soap bar as in claim 9 wherein the poly(ethylene oxide) has a molecular weight of about 300,000 to about 400,000 and further containing about 1 to about 5% of acetylated lanolin as superfatting agent, about 0.2 to about 1% of glycerine, and about 1 to about 3% of sodium coco isethionate.

17. A soap bar as in claim 11 wherein the poly(ethylene oxide) has a molecular weight of about 300,000 to about 400,000.

* * * * *